US009522467B1

(12) United States Patent
Kao

(10) Patent No.: US 9,522,467 B1
(45) Date of Patent: Dec. 20, 2016

(54) COMPOSITE TOOL HOLDER

(71) Applicant: Jui-Chien Kao, Taichung (TW)

(72) Inventor: Jui-Chien Kao, Taichung (TW)

( * ) Notice: Subject to any disclaimer, the term of this patent is extended or adjusted under 35 U.S.C. 154(b) by 0 days.

(21) Appl. No.: 15/089,274

(22) Filed: Apr. 1, 2016

Related U.S. Application Data

(63) Continuation-in-part of application No. 14/806,436, filed on Jul. 22, 2015.

(51) Int. Cl.
*B25H 3/06* (2006.01)
*A47F 7/00* (2006.01)
*B25H 3/00* (2006.01)
*B25H 3/04* (2006.01)

(52) U.S. Cl.
CPC ..... *B25H 3/06* (2013.01); *A47F 7/0028* (2013.01); *B25H 3/003* (2013.01); *B25H 3/04* (2013.01)

(58) Field of Classification Search
CPC ..... B25H 3/00; B25H 3/003; B25H 3/04; B25H 3/06; A47F 7/0028
USPC ..... 211/70.6; 206/234, 376, 378
See application file for complete search history.

(56) References Cited

U.S. PATENT DOCUMENTS 2,841,289 A * 7/1958 Odlum ..... B25H 3/003 211/70.6
5,368,164 A * 11/1994 Bennett ..... B25H 3/003 206/373
5,535,882 A * 7/1996 Liu ..... B25H 3/003 206/376
6,044,985 A * 4/2000 Kao ..... B25H 3/003 211/70.6
6,145,662 A * 11/2000 Newton ..... B25H 3/06 206/373
6,257,409 B1 * 7/2001 Lin ..... B25H 3/04 206/376
6,283,311 B1 * 9/2001 Lee ..... B25H 3/006 206/377
6,386,363 B1 * 5/2002 Huang ..... B25H 3/003 206/1.5
7,080,733 B2 * 7/2006 Kao ..... B25H 3/04 206/372
7,108,132 B2 * 9/2006 Shih ..... B25H 3/003 206/378
8,302,785 B2 * 11/2012 Kao ..... A47F 5/0846 211/70.6

(Continued)

FOREIGN PATENT DOCUMENTS

DE 202014106037 * 3/2015 ..... B25H 3/02
GB 2481590 * 1/2012 ..... B25H 3/04
GB 2524096 * 9/2015 ..... B25H 3/06

*Primary Examiner* — Michael Safavi
(74) *Attorney, Agent, or Firm* — Alleman Hall McCoy Russell & Tuttle LLP

(57) ABSTRACT

A composite tool holder has a base, a socket set, a hand tool set, and a bracket set. The base has a substrate, a first track, and a second track. The socket set is connected to the base and has a positioning plate mounted in the second track with multiple engaging recesses, and multiple positioning blocks mounted in the first track, abutting the positioning plate and having an engaging element selectively engaging with one of the engaging recesses. The hand tool set is detachably connected to the base and has at least one holding component deposited on the substrate. The bracket set is detachably connected to the base beside the socket set and has two supporting bases respectively connected to two sides of the base beside the socket set.

11 Claims, 18 Drawing Sheets

(56) References Cited

U.S. PATENT DOCUMENTS

| | | | | |
|---|---|---|---|---|
| 8,317,021 | B2 * | 11/2012 | Christopher | B25H 3/022<br>206/234 |
| 8,505,720 | B2 * | 8/2013 | Huang | B25H 3/00<br>206/349 |
| 8,813,957 | B1 * | 8/2014 | Kao | B25H 3/003<br>206/378 |
| 2001/0001197 | A1 * | 5/2001 | Ramsey | B25H 3/06<br>206/378 |
| 2007/0023369 | A1 * | 2/2007 | Lin | B25H 3/003<br>211/70.6 |
| 2009/0146032 | A1 * | 6/2009 | Bettenhausen | A61B 50/34<br>248/220.31 |
| 2011/0089126 | A1 * | 4/2011 | Hsieh | B25H 3/003<br>211/70.6 |
| 2011/0180499 | A1 * | 7/2011 | Sun | B25H 3/04<br>211/70.6 |
| 2012/0138553 | A1 * | 6/2012 | Kao | B25H 3/06<br>211/70.6 |
| 2012/0267271 | A1 * | 10/2012 | Huang | B25H 3/04<br>206/349 |
| 2013/0118938 | A1 * | 5/2013 | Huang | B25H 3/00<br>206/372 |

* cited by examiner

COMPOSITE TOOL HOLDER

CROSS REFERENCE TO RELATED APPLICATIONS

The present application is a continuation-in-part of U.S. Non-Provisional application Ser. No. 14/806,436 entitled "COMPOSITE TOOL HOLDER," and filed on Jul. 22, 2015, the entire contents of which are hereby incorporated by reference for all purposes.

BACKGROUND OF THE INVENTION

1. Field of the Invention

The present invention relates to a holder, specifically to a composite tool holder capable of storing both hand tools and sleeves.

2. Description of the Related Art

A conventional tool holder mainly has a base and a plurality of movable positioning blocks engaging with the base. A sliding track is formed on a top surface of the base, and each one of the positioning blocks has a sliding base formed on a bottom of the positioning block for engaging with the sliding track. An inserting portion is formed upward on a top surface of the sliding base of the positioning block, and the inserting portion can be a socket or a hanging rod. When the inserting portion of each one of the positioning blocks is the socket, the socket can be used for storing a sleeve. Furthermore, when the inserting portion of each one of the positioning blocks is the hanging rod, a hand tool such as a socket wrench can be hung on the hanging rod.

A user mostly needs to use the sleeve and the hand tool at the same time to fasten or unfasten a fastener, such as a bolt or a nut, but the conventional tool holder cannot hold the sleeve and the hand tool at the same time. Oftentimes the user may forget to bring the sleeve or the hand tool, resulting in inconvenience. Moreover, when the user needs to use the sleeve and the hand tool at the same time, the conventional tool holder may cause inconvenience in carrying or storing the sleeve and the hand tool. Therefore, the conventional tool holder needs to be improved.

SUMMARY OF THE INVENTION

The main objective of the present invention is to provide a composite tool holder that may store both hand tools and sleeves.

The composite tool holder in accordance with the present invention has a base, a socket set, a hand tool set, and a bracket set. The base has a substrate, a first track, and a second track. The socket set is connected to the base and has a positioning plate mounted in the second track with multiple engaging recesses, and multiple positioning blocks mounted in the first track, abutting the positioning plate and having an engaging element selectively engaging with one of the engaging recesses. The hand tool set is detachably connected to the base and has at least one holding component deposited on the substrate. The bracket set is detachably connected to the base beside the socket set and has two supporting bases respectively connected to two sides of the base beside the socket set.

Other objectives, advantages and novel features of the invention will become more apparent from the following detailed description when taken in conjunction with the accompanying drawings.

DETAILED DESCRIPTION OF THE INVENTION

With reference to FIGS. 1 to 4, a first embodiment of a composite tool holder in accordance with the present invention has a base 10, a socket set 20, a hand tool set 30, and a bracket set 40.

Figure 3:
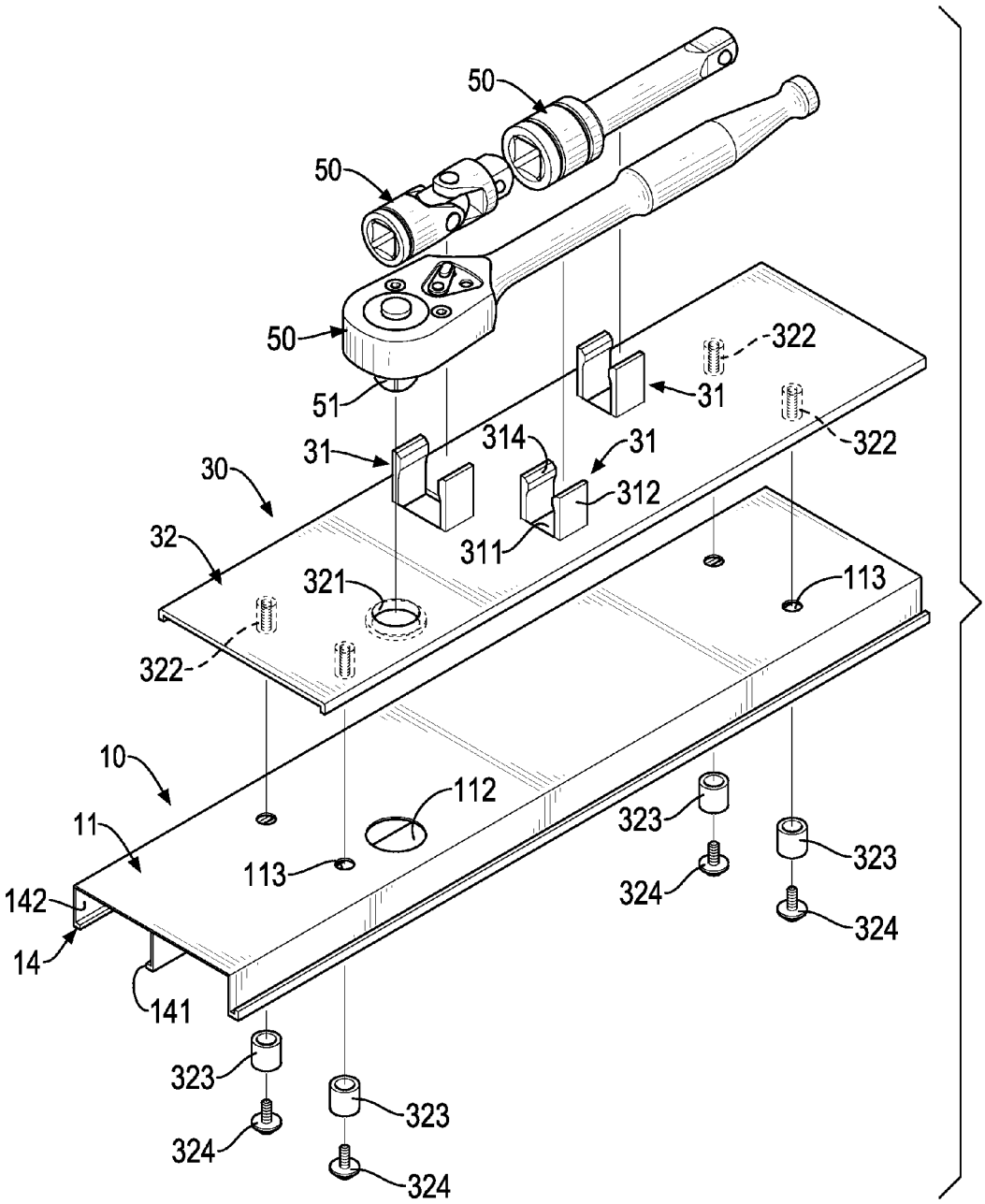
FIG. 3 is a further exploded view of the composite tool holder in FIG. 2.

The base 10 is an extruded aluminum structure and comprises a substrate 11, a first track 12, a second track 13, and two enclosed tracks 14. With further reference to FIG. 3, the substrate 11 is a rectangular plate extending horizontally and has a top surface, a bottom surface, two elongated sides, a length, at least one receiving hole 112, and multiple assembling holes 113. The at least one receiving hole 112 is formed through the top surface and the bottom surface of the substrate 11. The assembling holes 113 are formed through the top surface and the bottom surface of the substrate 11 at spaced intervals.

Figure 2:
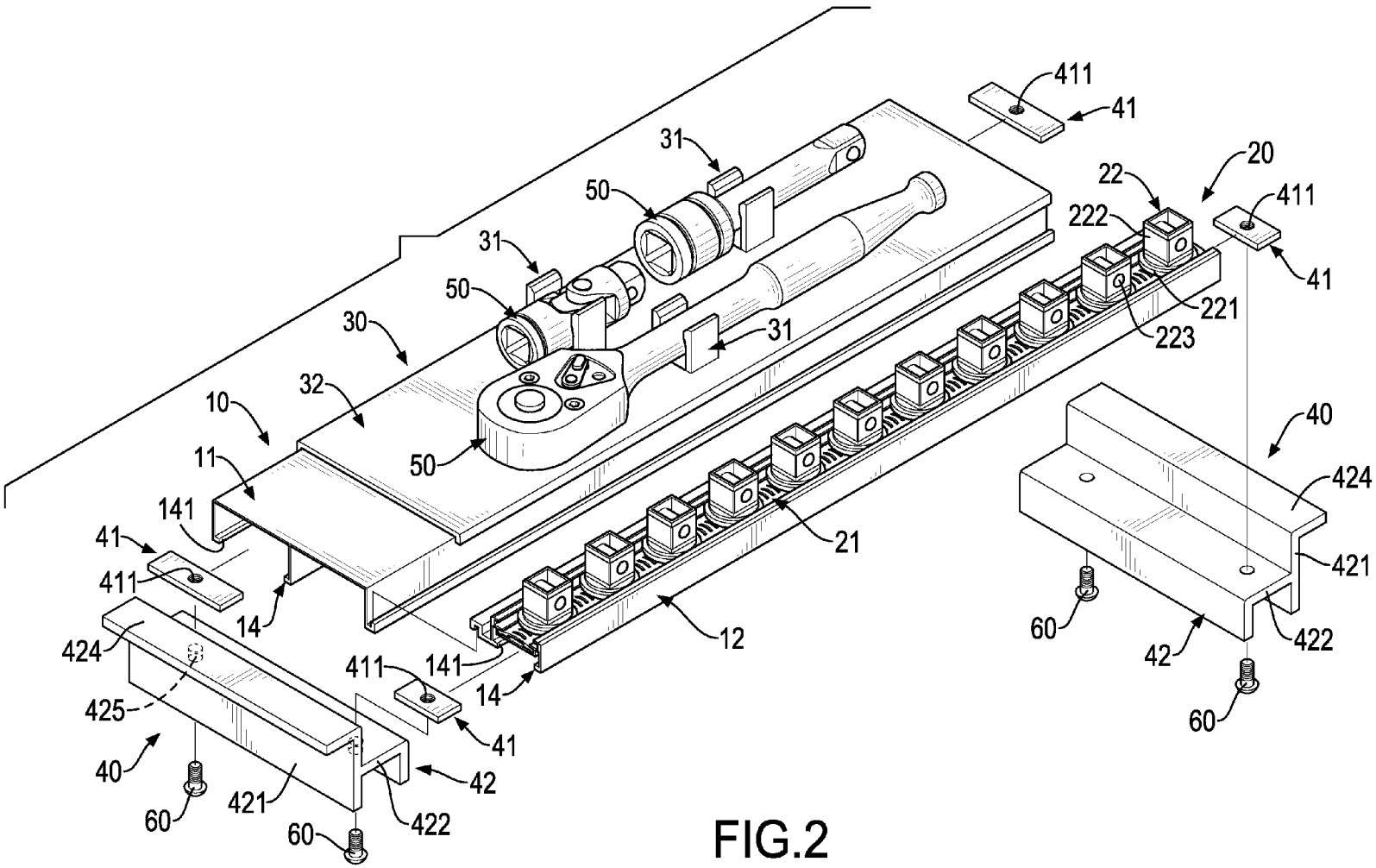
FIG. 2 is an exploded perspective view of the composite tool holder in FIG. 1.
Figure 4:
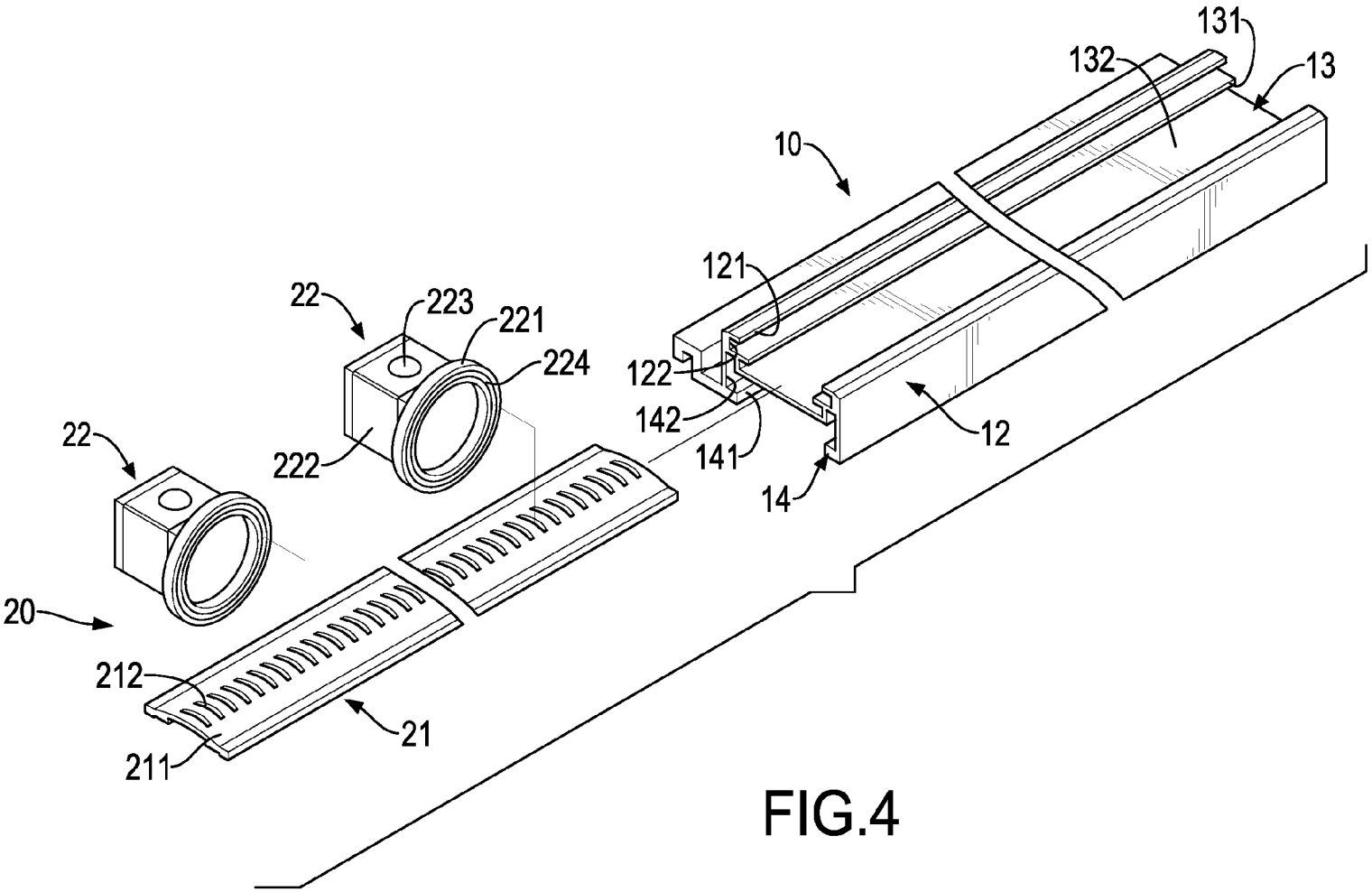
FIG. 4 is another exploded view of the composite tool holder in FIG. 2.
Figure 5:
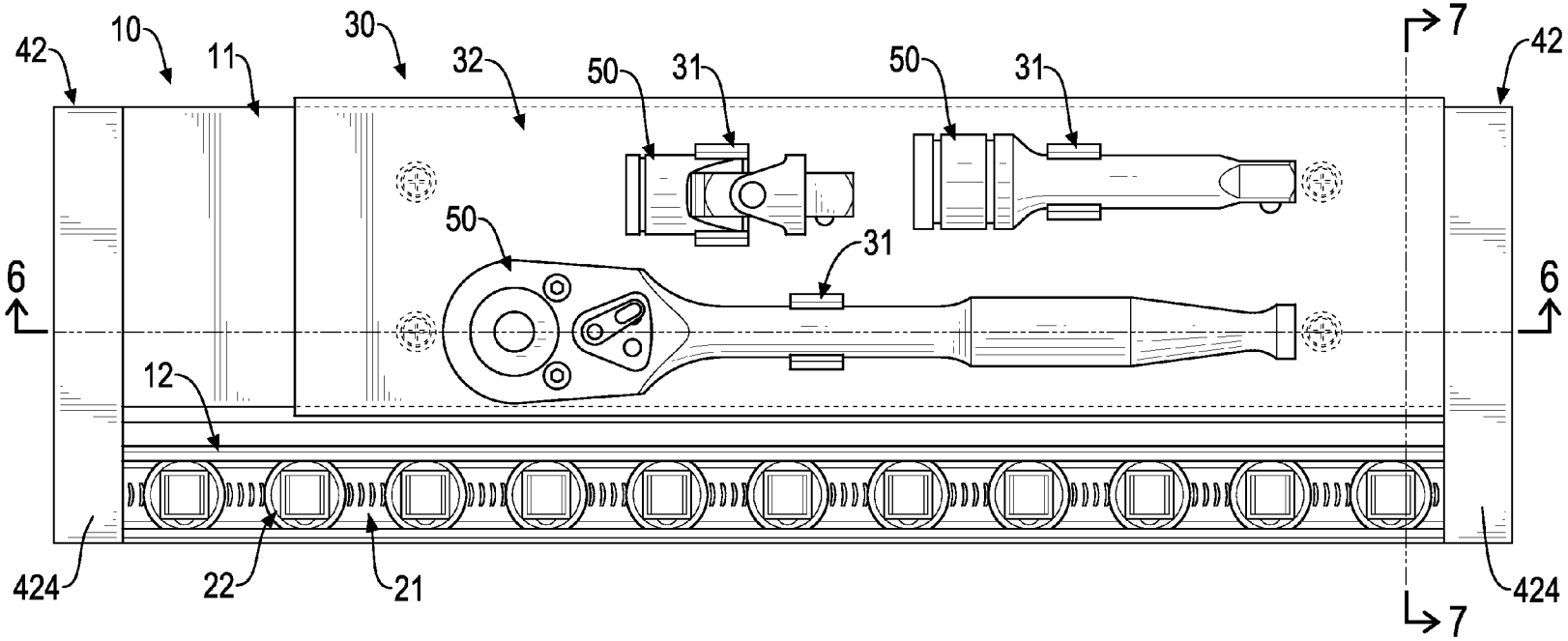
FIG. 5 is a top side view of the composite tool holder in FIG. 1.

With reference to FIGS. 2 and 4, the first track 12 is detachably connected to one of the elongated sides of the substrate 11 by a hooking structure between the substrate 11 and the first track 12. The first track 12 has a length, a top surface, a bottom surface, an upper opening 121, and a sliding slot 122. The length of the first track 12 is equal to the length of the substrate 11. The upper opening 121 is formed through the top surface of the first track 12. The sliding slot 122 is formed in the first track 12 and communicates with the upper opening 121.

With reference to FIG. 4, the second track 13 is formed on the bottom surface of the first track 12, and has a top opening 131 and an engaging slot 132. The top opening 131 is formed through the bottom surface of the first track 12 and communicates with the sliding slot 122. The engaging slot 132 is formed in the second track 13 and communicates with the top opening 131.

Figure 7:
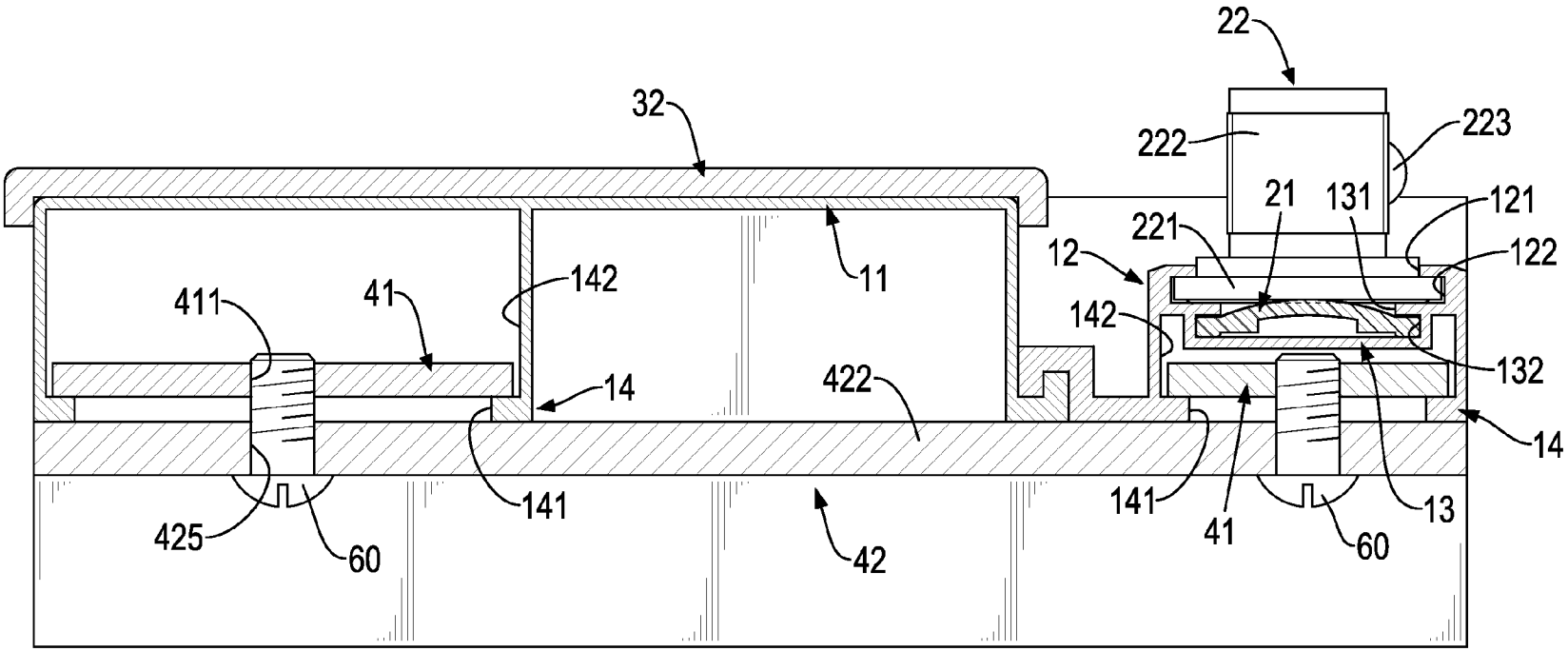
FIG. 7 is an enlarged side view in partial section of the composite tool holder in FIG. 5 along line 7-7.

With reference to FIGS. 2, 4, and 7, one of the enclosed tracks 14 is formed downwardly on the bottom surface of the substrate 11 along one of the two elongated sides that is opposite to the first track 12, and communicates with some of the assembling holes 113. The other one of the enclosed track 14 is formed downwardly on the bottom surface of the first track 12 around the second track 13. Each one of the enclosed tracks 14 has a bottom surface, a lower opening 141, and an enclosed slot 142. The lower opening 141 is formed through the bottom surface of the enclosed track 14. The enclosed slot 142 is formed in the enclosed track 14 and communicates with the lower opening 141.

With reference to FIGS. 2, 4, 7, and 8, the socket set 20 is connected to the base 10 and has a positioning plate 21 and multiple positioning blocks 22. The positioning plate 21 is a strip-shaped plate with resilience, is disposed in the engaging slot 132 of the second track 13, and has two long opposite sides, a middle, an abutting portion 211, and multiple engaging recesses 212. The abutting portion 211 is an arc-shaped and is bent upwardly from the long opposite sides to the middle of the positioning plate 21 and has a top surface. The engaging recesses 212 are curved and are formed in the top surface of the abutting portion 211 at spaced intervals.

The positioning blocks 22 are rotatably and slidably mounted in the first track 12 and abut the positioning plate 21, and each one of the positioning blocks 22 has an engaging portion 221 and an inserting portion 222. The engaging portion 221 of the positioning block 22 is mounted in the sliding slot 122 of the first track 12, abuts the abutting portion 211 of the positioning plate 21, and has a bottom surface, a top surface, and an engaging element 224. Preferably, the engaging portion 221 of the positioning block 22 may be a circular plate of a flattened structure or a stepped structure and may be rotated relative to the first track 12. The engaging element 224 is an engaging ring, is formed on and protrudes downwardly from the bottom surface of the engaging portion 221 and selectively engages with one of the engaging recesses 212 of the positioning plate 21 to hold the positioning block 22 securely on the positioning plate 21 without sliding relative to the first track 12.

Figure 8B:
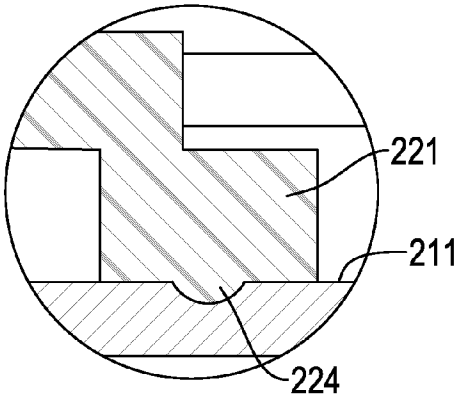
FIGS. 8A and 8B are enlarged and cross sectional side views of the composite tool holder in FIG. 8.
Figure 8A:
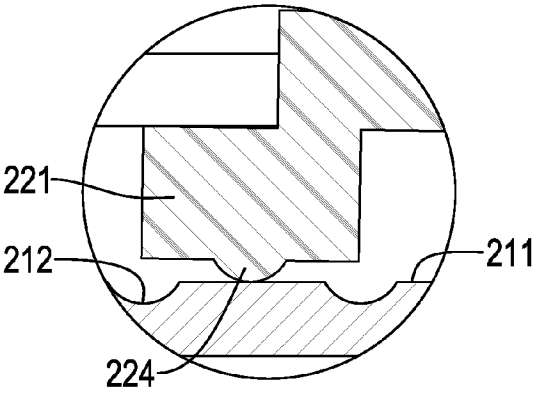

With reference to FIGS. 8A and 8B, a part of the engaging ring engages in one of the engaging recesses 212 and the remaining part of the engaging ring presses against the top surface of the abutting portion 211. Then, the abutment relationship between the engaging ring and the positioning plate 21 may allow the part of the engaging ring to engage more securely in the corresponding engaging recess 212, and the positioning block 22 may be securely positioned on the positioning plate 21.

The inserting portion 222 is formed on and protrudes from the top surface of the engaging portion 221 and extends out of the first track 12 via the upper opening 121. The inserting portion 222 has an outer surface and a constraining protrusion 223. The constraining protrusion 223 is deposited on the outer surface of the inserting portion 222, so that a sleeve may firmly engage with the inserting portion 222 of the positioning block 22.

With reference to FIGS. 2, 3, 5, and 6, the hand tool set 30 is detachably connected to the base 10 and has at least one holding component 31, each one of the at least one holding component 31 is deposited on the substrate 11. Preferably, the hand tool set 30 further has a mounting cover 32 detachably mounted on the substrate 11, and the mounting cover 32 may be U-shaped and has a top surface, a bottom surface, at least one mounting hole 321, and multiple inserting tubes 322. The at least one mounting hole 321 is formed through the top surface and the bottom surface of the mounting cover 32 and aligns with the at least one receiving hole 112 of the substrate 11. The inserting tubes 322 are formed on and protrude downwardly from the bottom surface of the mounting cover 32 at spaced intervals, and are respectively mounted into the assembling holes 113 of the substrate 11 when the bottom surface of the mounting cover 32 abuts the top surface of the substrate 11. Furthermore, the mounting cover 32 has multiple washers 323 respectively mounted around the inserting tubes 322 that extend through the substrate 11, and multiple fasteners 324 are respectively connected to the inserting tubes 322 and are pressed against the washers 323. Then, the mounting cover 32 is securely mounted on the substrate 11.

Additionally, each one of the at least one holding component 31 is formed on the top surface of the mounting cover 32 and has a combining portion 311 and a holding portion 312. The combining portion 311 is formed on the top surface of the mounting cover 32 and has a top surface. The holding portion 312 is U-shaped, is integrally formed on the top surface of the combining portion 311 and is disposed above the mounting cover 32. Then, a hand tool 50 may be securely mounted on the mounting cover 32 over the substrate 11 by the holding portion 312 of the at least one holding component 31. Preferably, the holding portion 312 has two free ends and two holding protrusions 314 respectively formed on the free ends of the holding portion 312.

Figure 6:
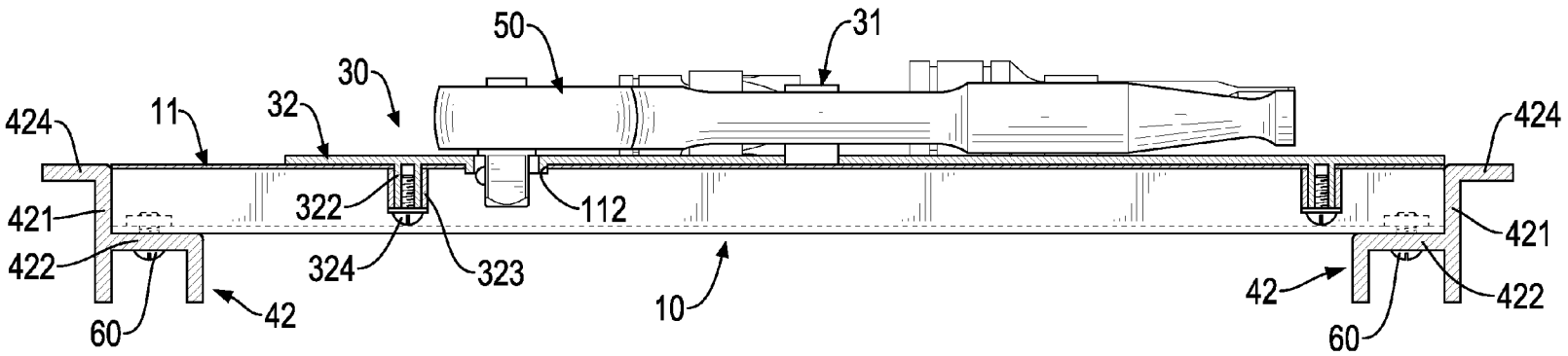
FIG. 6 is a side view in partial section of the composite tool holder in FIG. 5 along line 6-6.

With reference to FIGS. 3 and 6, a protrusion head 51 of the hand tool 50 may extend through the substrate 11 via the at least one mounting hole 321 and the at least one receiving hole 112, such that the hand tool 50 may be positioned firmly on the mounting cover 32 over the substrate 11 by the at least one holding component 31, the at least one mounting hole 321, and the at least one receiving hole 112.

With reference to FIGS. 2, 6, and 7, the bracket set 40 is detachably connected to the base 10 beside the socket set 20, and has multiple fixing plates 41 and two supporting bases 42. Each one of the fixing plates 41 is a rectangular plate and disposed in one of the enclosed tracks 14 and near an end of the substrate 11 or an end of the first track 12. Each of the fixing plates 41 has a fixing hole 411 formed through the fixing plate 41 and communicating with the lower opening 141 of a corresponding enclosed track 14.

The supporting bases 42 are extruded aluminum structures and are connected to the base 10 beside the socket set 20, so as to enclose the first track 12, the second track 13, and the enclosed tracks 14. Each one of the supporting bases 42 has an enclosed plate 421 and an extending plate 422. The enclosed plate 421 is disposed vertically and abuts one of two sides of the base 10, so as to enclose the first track 12, the second track 13, and the enclosed tracks 14.

The extending plate 422 is transversally formed on and protrudes from the enclosed plate 421 and abuts the enclosed tracks 14 under the base 10, and has two fixing holes 425 formed through the extending plate 422 at a spaced interval, so that two fixing components 60 may be respectively mounted through the two holes 425 and respectively connected to the fixing holes 411 of the fixing plates 41 that are mounted at a same side of the base 10. Then, the supporting base 42 can be disposed on the side of the base 10 by the engagement of the two fixing components 60 and the two corresponding fixing plates 41.

Furthermore, each one of the supporting bases 42 has a supporting plate 424 horizontally formed on a top of the enclosed plate 421, and the supporting plate 424 is aligned to the substrate 11. Therefore, a user can lift the composite tool holder by holding the supporting plates 424 of the two supporting bases 42.

Figure 1:
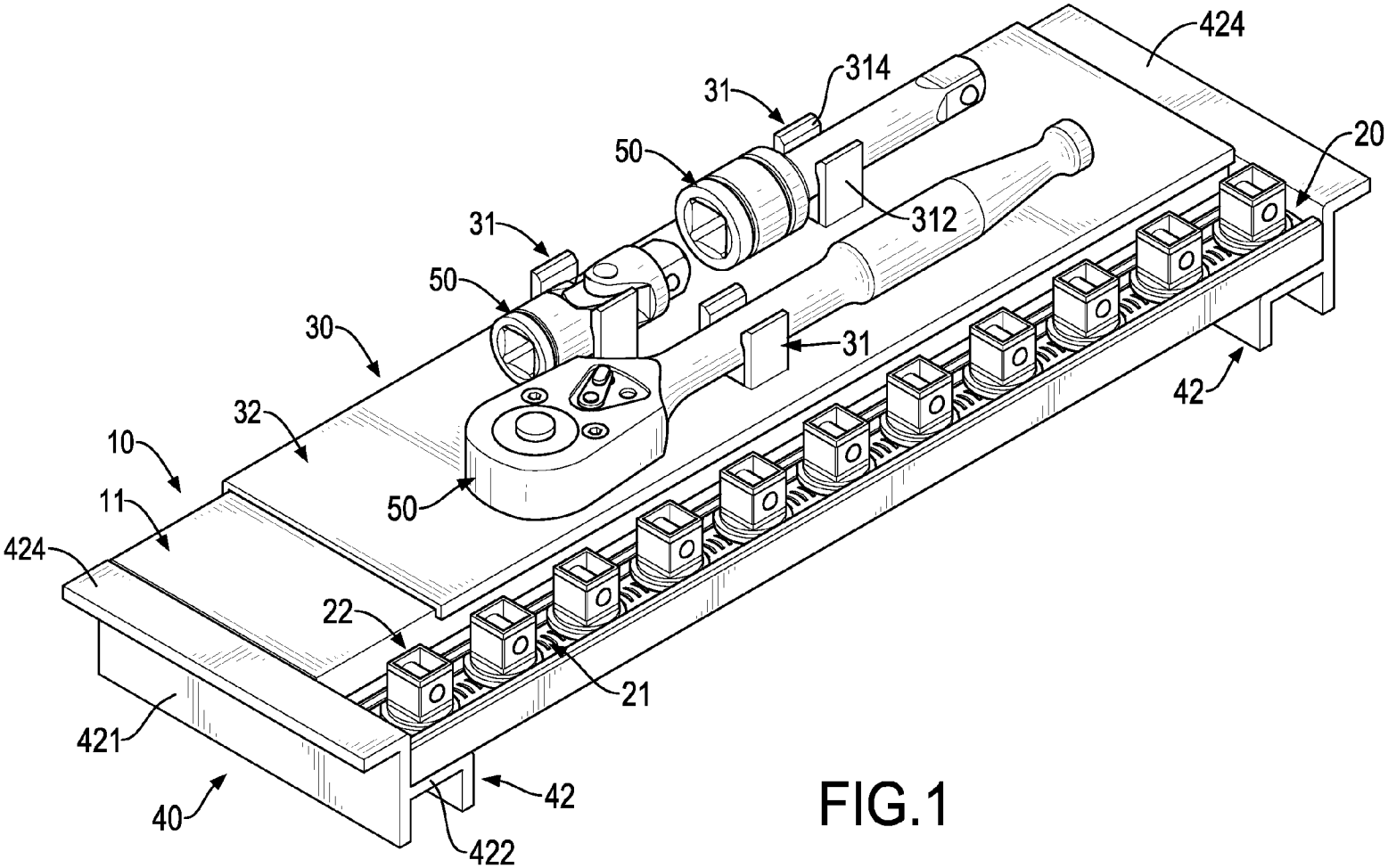
FIG. 1 is a perspective view of a first embodiment of a composite tool holder in accordance with the present invention.
Figure 8:
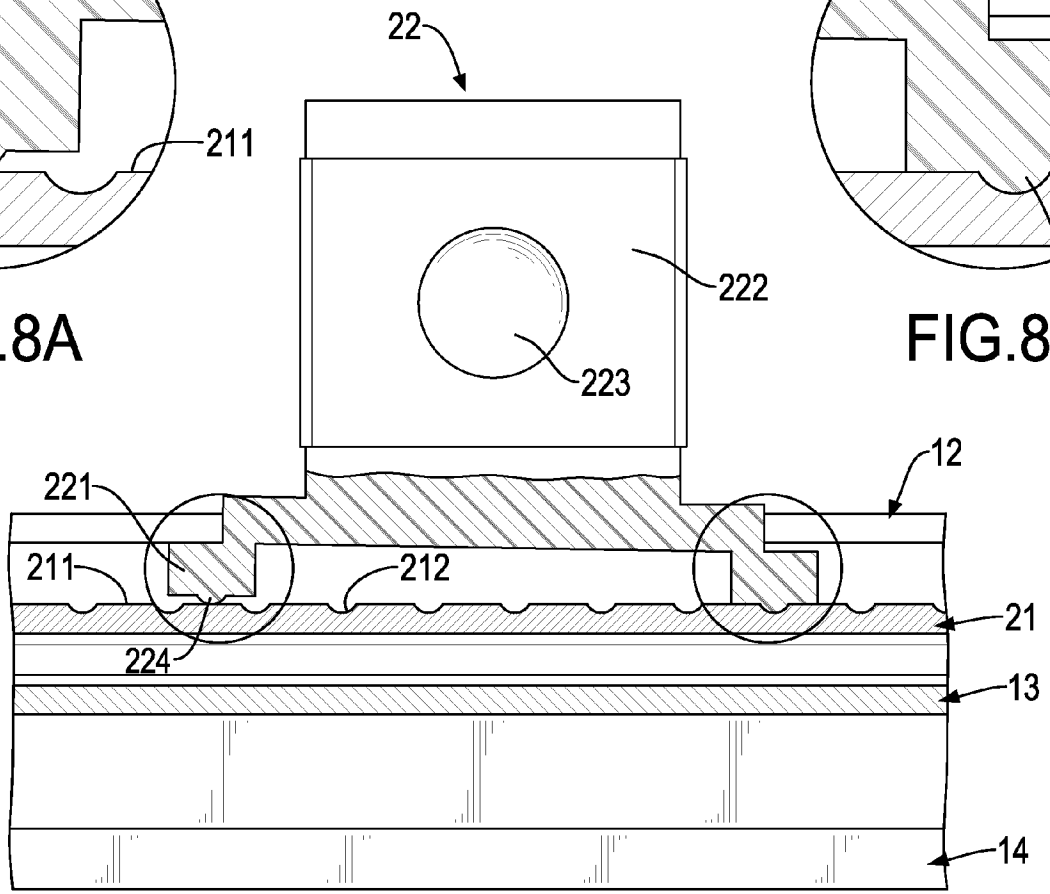
FIG. 8 is an enlarged and side view in partial section of the composite tool holder in FIG. 1.
Figure 9:
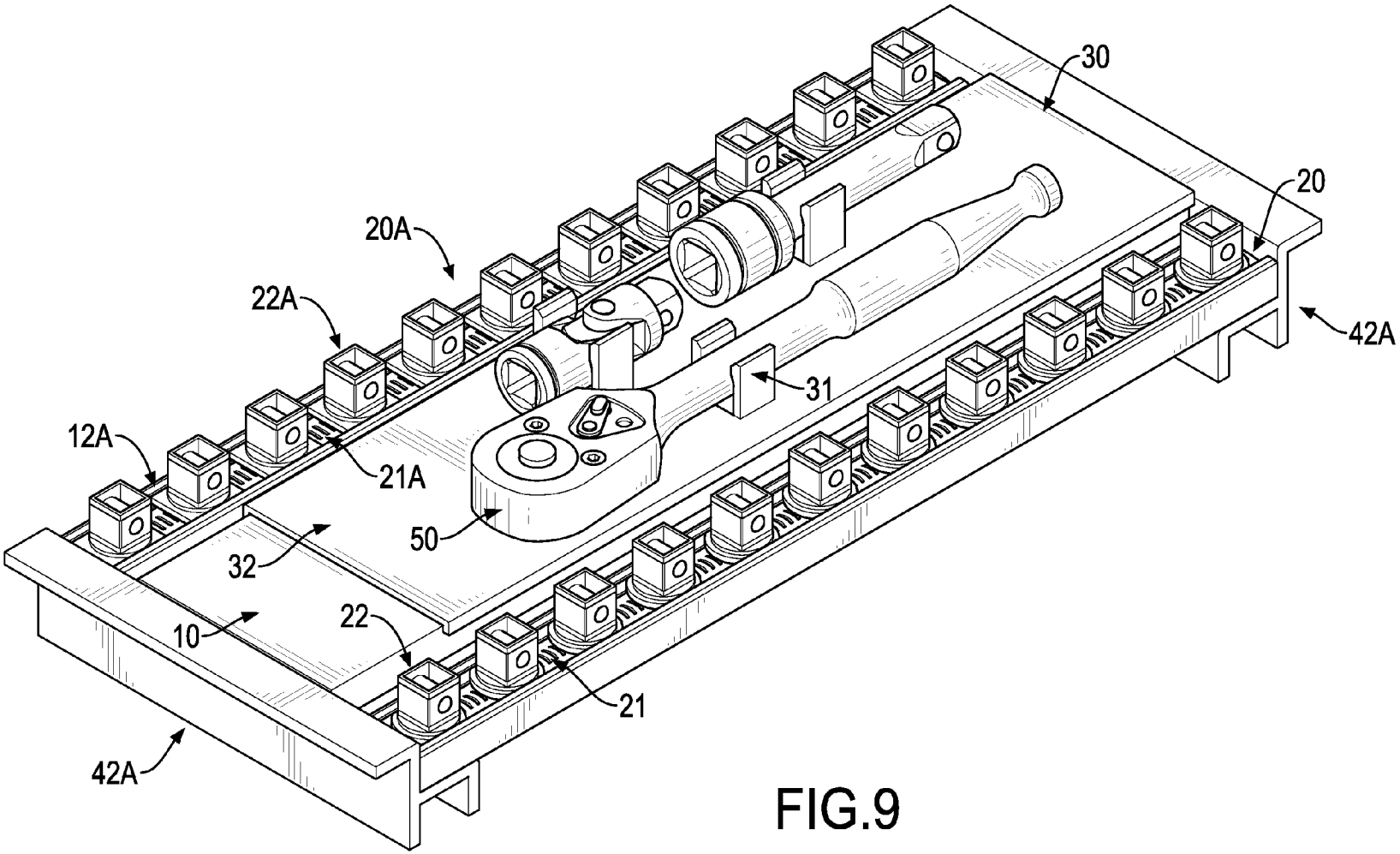
FIG. 9 is a perspective view of a second embodiment of a composite tool holder in accordance with the present invention.
Figure 10:
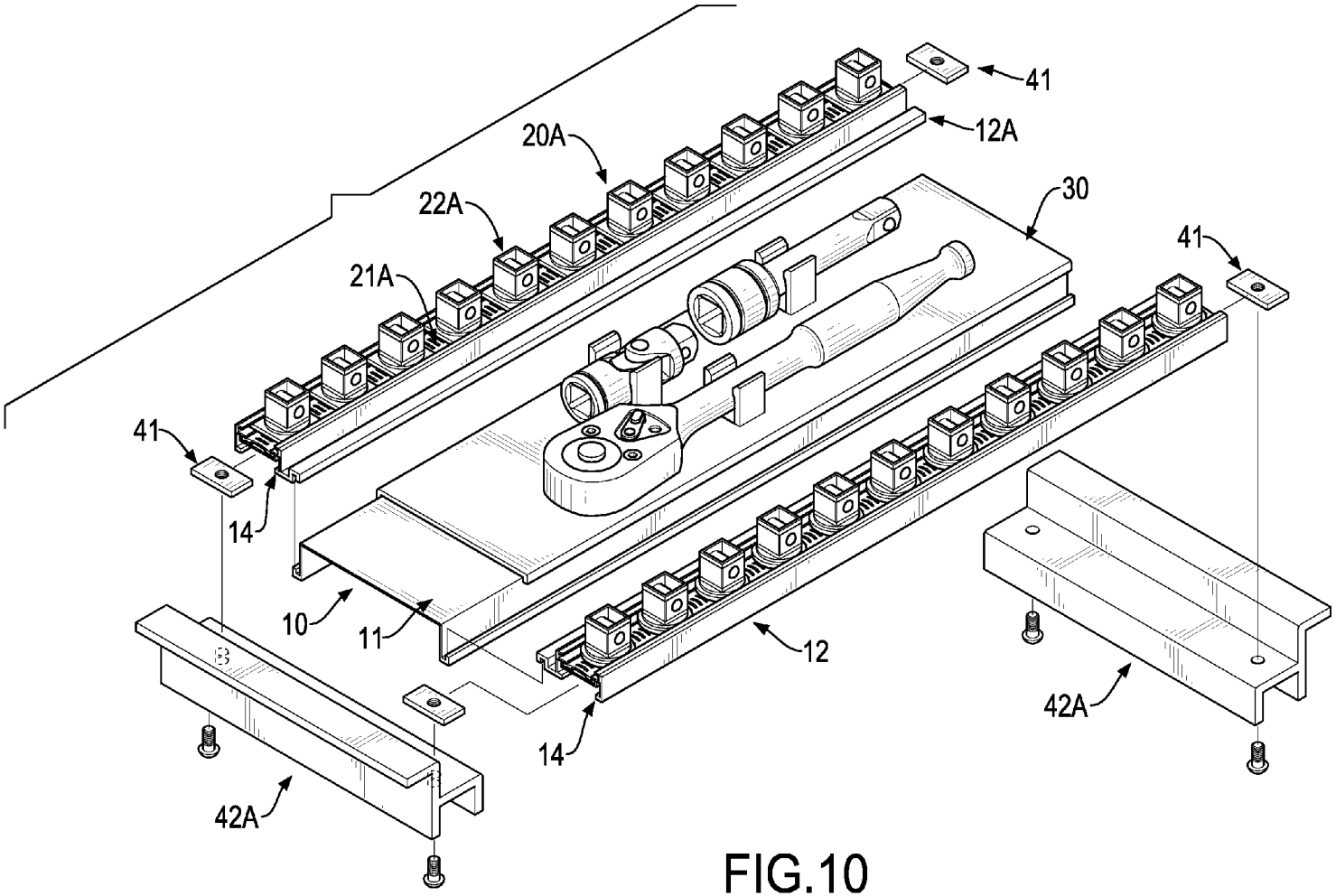
FIG. 10 is an exploded perspective view of the composite tool holder in FIG. 9.
Figure 11:
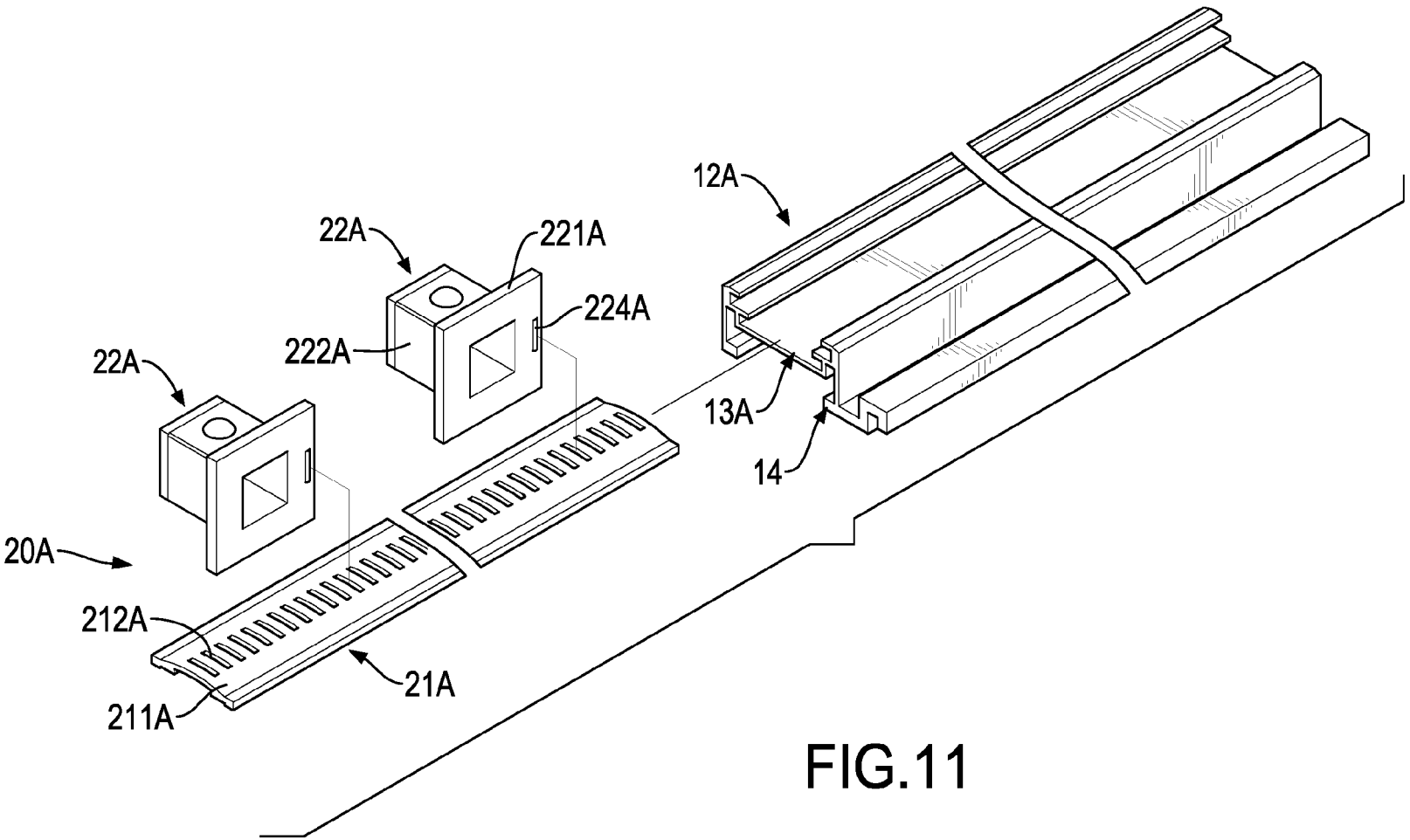
FIG. 11 is another exploded view of the composite tool holder in FIG. 10.
Figure 12:
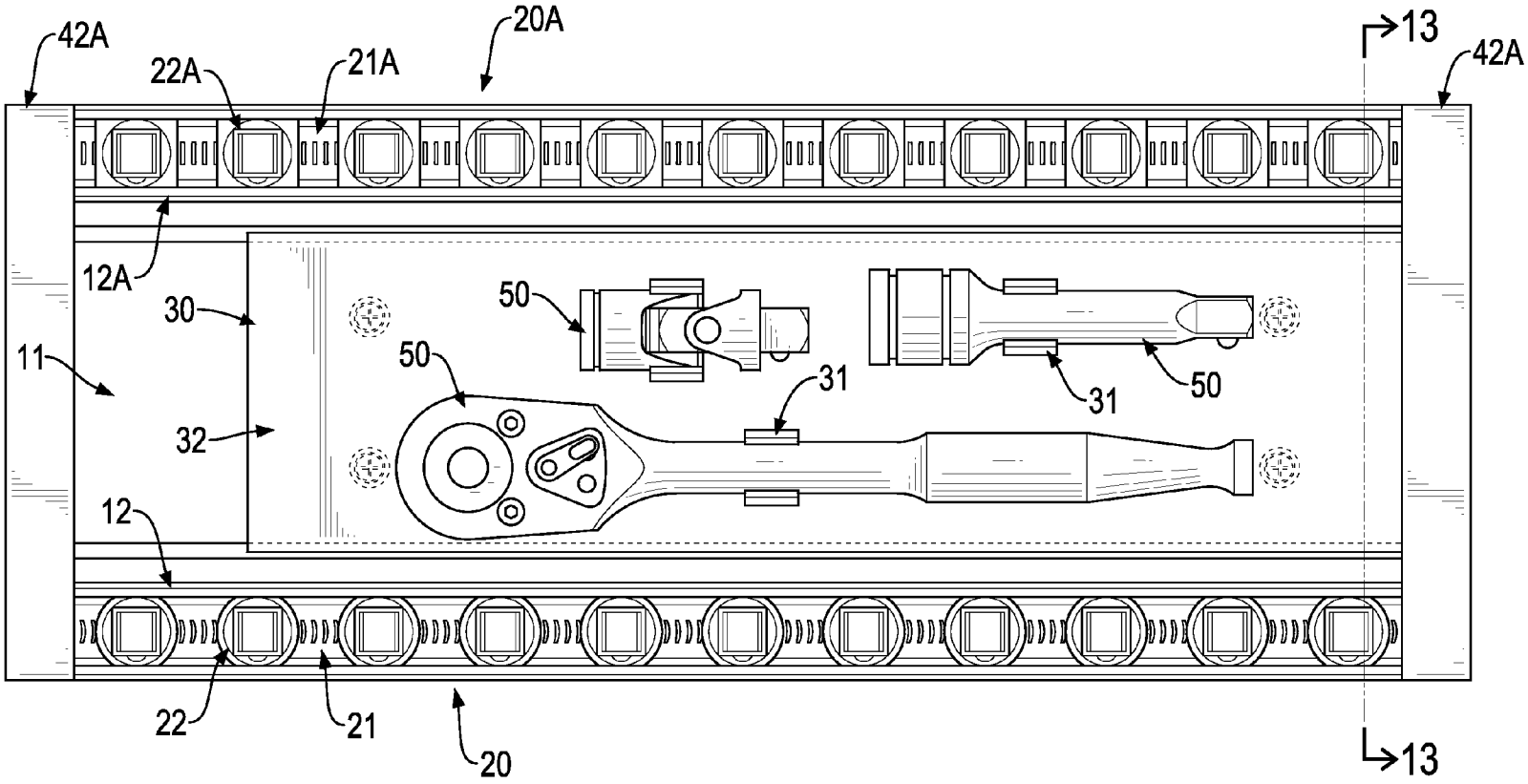
FIG. 12 is a top side view of the composite tool holder in FIG. 9.

With reference to FIGS. 1, 7, and 8, when the first embodiment of the invention is in use, the user can mount a sleeve around the inserting portion 222 of one of the positioning blocks 22 of the socket set 20, and the sleeve can be firmly disposed on the positioning block 22 by the constraining protrusion 223. The user can apply a force to the sleeve to drive the positioning block 22 to rotate relative to the positioning plate 21, so that a size mark on an outer surface of the sleeve is rotated to face the user for ease of retrieving and identifying the hand tool. In addition, with reference to FIG. 4, the engaging portion 221 of each one of the positioning blocks 22 abuts the abutting portion 211 of the positioning plate 21, and the engaging element 224 of each one of the positioning blocks 22 engages with one of the engaging recesses 212 of the positioning plate 21 to hold the positioning block 22 securely on the positioning plate 21 without sliding relative to the first track 12.

After the user rotates or slides the sleeve, the positioning block 22 and the positioning plate 21 abut each other and are firmly disposed in the first track 12 by the engagement between the engaging element 224 and a corresponding engaging recess 212. Therefore, the sleeve on the positioning block 22 does not rotate or slide relative to the first track 12. That is, the sleeve can be firmly disposed on the base 10.

With reference to FIGS. 1, 3, 5, and 6, the user can position the hand tool 50 on the mounting cover 32 over the substrate 11 by the two holding protrusions 314 of the at least one holding component 31 of the hand tool set 30, and the hand tool 50 can cooperate with the sleeve mounted on the positioning block 22. The hand tool 50 has a protrusion head 51 extending to the bottom surface of the substrate 11 via the at least one mounting hole 321 of the mounting cover 32 and the at least one receiving hole 112 of the substrate 11. In addition, the hand tool 50 can be positioned on the mounting cover 32 over the substrate 11 by the at least one holding component 31, the at least one mounting hole 321, and the at least one receiving hole 112. Furthermore, with reference to FIGS. 1 and 2, after the sleeve and the hand tool 50 are positioned on the base 10 by the socket set 20 and the hand tool set 30, the sleeve and the hand tool 50 disposed on the base 10 can be stored at the same time to facilitate convenience in use and prevent the user from forgetting to bring the sleeve or the hand tool 50.

With reference to FIGS. 9 to 13, a second embodiment of a composite tool holder in accordance with the present invention is substantially the same as the first embodiment except for the following features. The composite tool holder further has an auxiliary first track 12A, an auxiliary second track 13A, and an auxiliary socket set 20A. The auxiliary first track 12A is detachably connected to one of the elongated sides of the substrate 11 by a hooking structure between the substrate 11 and the auxiliary first track 12A, and is opposite to the first track 12. That is, the first track 12 and the auxiliary first track 12A are respectively connected to the two elongated sides of the substrate 11. The auxiliary second track 13A is formed on the auxiliary first track 12A. In addition, the structures of the auxiliary first track 12A and the auxiliary second track 13A are substantially the same as the first track 12 and the second track 13. Furthermore, the two enclosed tracks 14 are respectively formed downwardly on the first track 12 and the auxiliary first track 12A respectively around the second track 13 and the auxiliary second track 13A.

The auxiliary socket set 20A is connected to the auxiliary first track 12A and the auxiliary second track 13A, and has a positioning plate 21A and multiple positioning blocks 22A. The positioning plate 21A of the auxiliary socket set 20A is mounted in the auxiliary second track 13A, and each one of the engaging recesses 212A is elongated and is formed in the top surface of the abutting portion 211A at spaced intervals.

The positioning blocks 22A are un-rotatably and slidably mounted in the auxiliary first track 12A and abut the positioning plate 21A, and each one of the positioning blocks 22A has an engaging portion 221A and an inserting portion 222A. The engaging portion 221A is rectangular, is mounted in the auxiliary first track 12A, and abuts the abutting portion 211A of the positioning plate 21A. The engaging element 224A of the engaging portion 221A is an elongated engaging rib, and selectively engages with one of the engaging recesses 212A of the positioning plate 21A to hold the positioning block 22A securely on the positioning plate 21A without sliding relative to the auxiliary first track 12A.

Furthermore, the length of each one of the supporting bases 42A is long enough to enclose the first track 12, the auxiliary track 12A, the second track 13, the auxiliary second track 13A, and the enclosed tracks 14.

Figure 13:
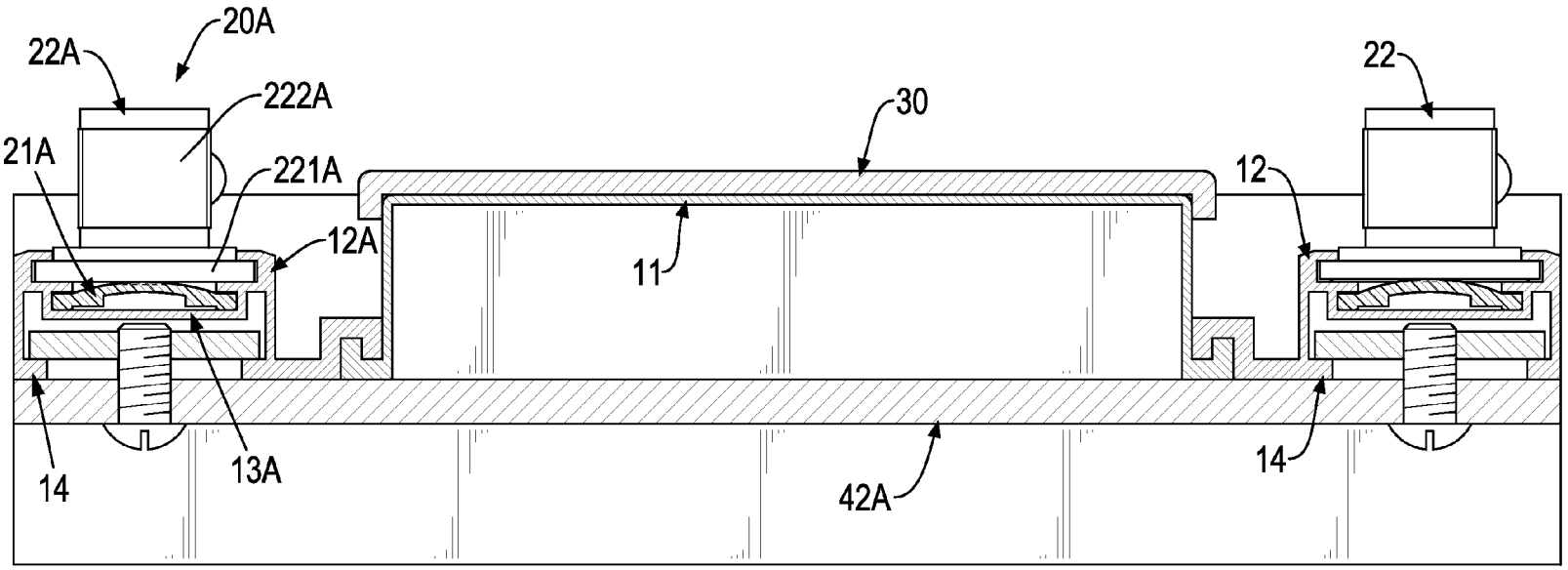
FIG. 13 is an enlarged side view in partial section of the composite tool holder in FIG. 12 along line 13-13.
Figure 14:
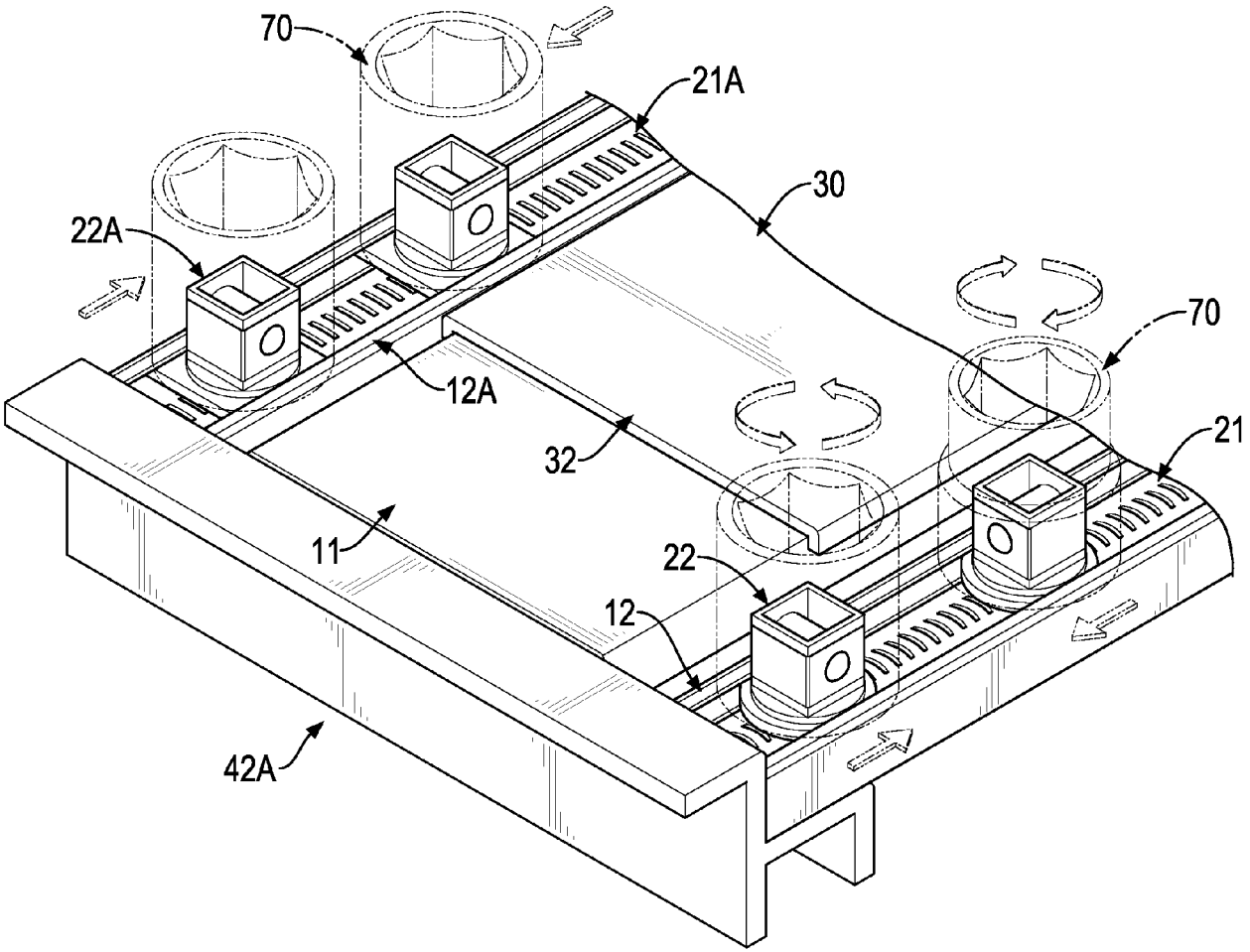
FIG. 14 is an operational perspective view of the composite tool holder in FIG. 9.

With reference to FIGS. 13 and 14, when the composite tool holder of the second embodiment in the present invention is in use, sleeves 70 may be mounted around the inserting portions 222, 222A of the positioning blocks 22, 22A of the socket set 20 and the auxiliary socket set 20A, since the engaging portions 221 of the socket set 20 are circular plates, and the sleeves 70 that are mounted around the positioning blocks 22 of the socket set 20 may be rotated and slid relative to the first track 12. Furthermore, since the engaging portions 221A of the auxiliary socket set 20A are rectangular, and the sleeves 70 that are mounted around the positioning blocks 22A of the auxiliary socket set 20A can only slide relative to the auxiliary first track 12A without rotating.

Figure 15:
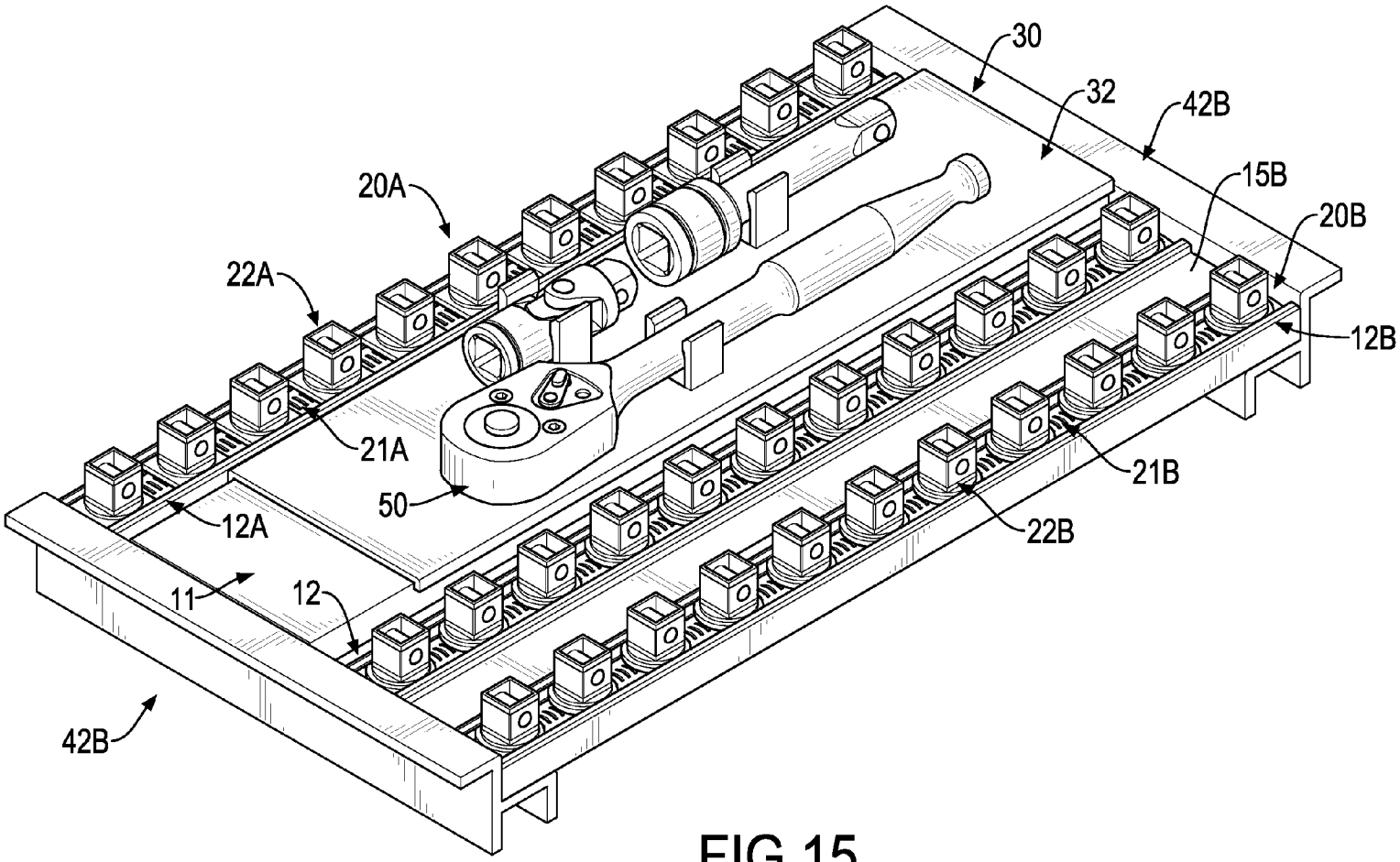
FIG. 15 is a perspective view of a third embodiment of a composite tool holder in accordance with the present invention.
Figure 16:
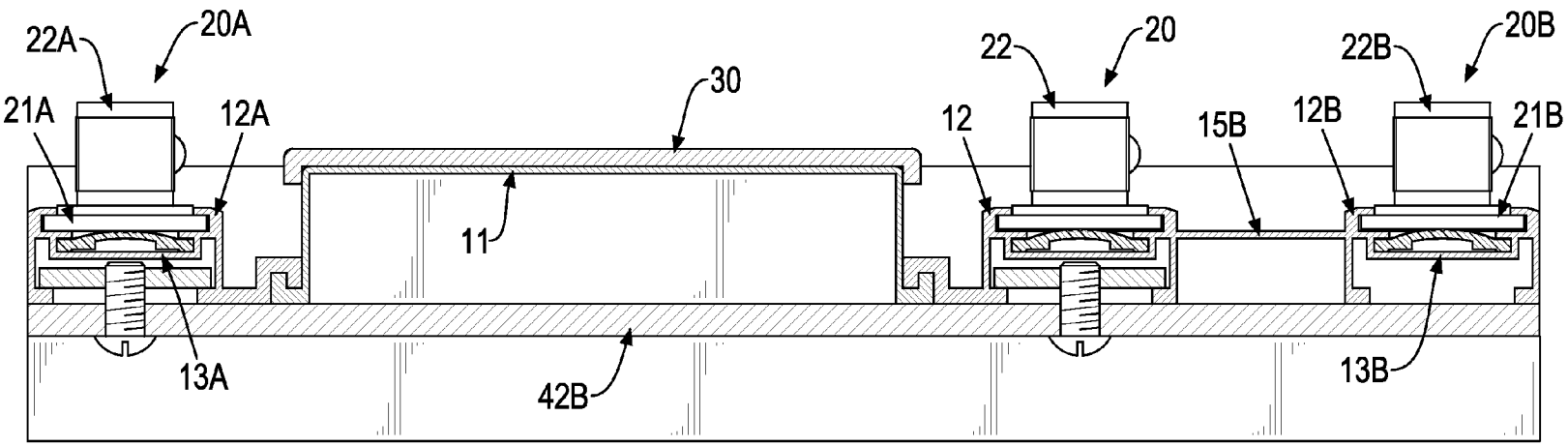
FIG. 16 is an enlarged side view in partial section of the composite tool holder in FIG. 15.

With reference to FIGS. 15 and 16, a third embodiment of a composite tool holder in accordance with the present invention is substantially the same as the second embodiment except for the following features. The composite tool holder further has an extending first track 12B, an extending second track 13B, and an additional socket set 20B. The extending first track 12B is connected to and parallel with the first track 12 by an extending panel 15B, the extending second track 13B is formed on the extending first track 12B, and the additional socket set 20B is connected to the extending first track 12B and the extending second track 13B. Furthermore, the structures of the extending first track 12B, the extending second track 13B, and the additional socket set 20B are respectively and substantially the same as the first track 12, the second track 13, and the socket set 20. With the increasing structures of the extending first track base 12B, the extending second track 13B, and the additional socket set 20B, the composite tool holder may store more sleeves on the composite tool holder.

Figure 17:
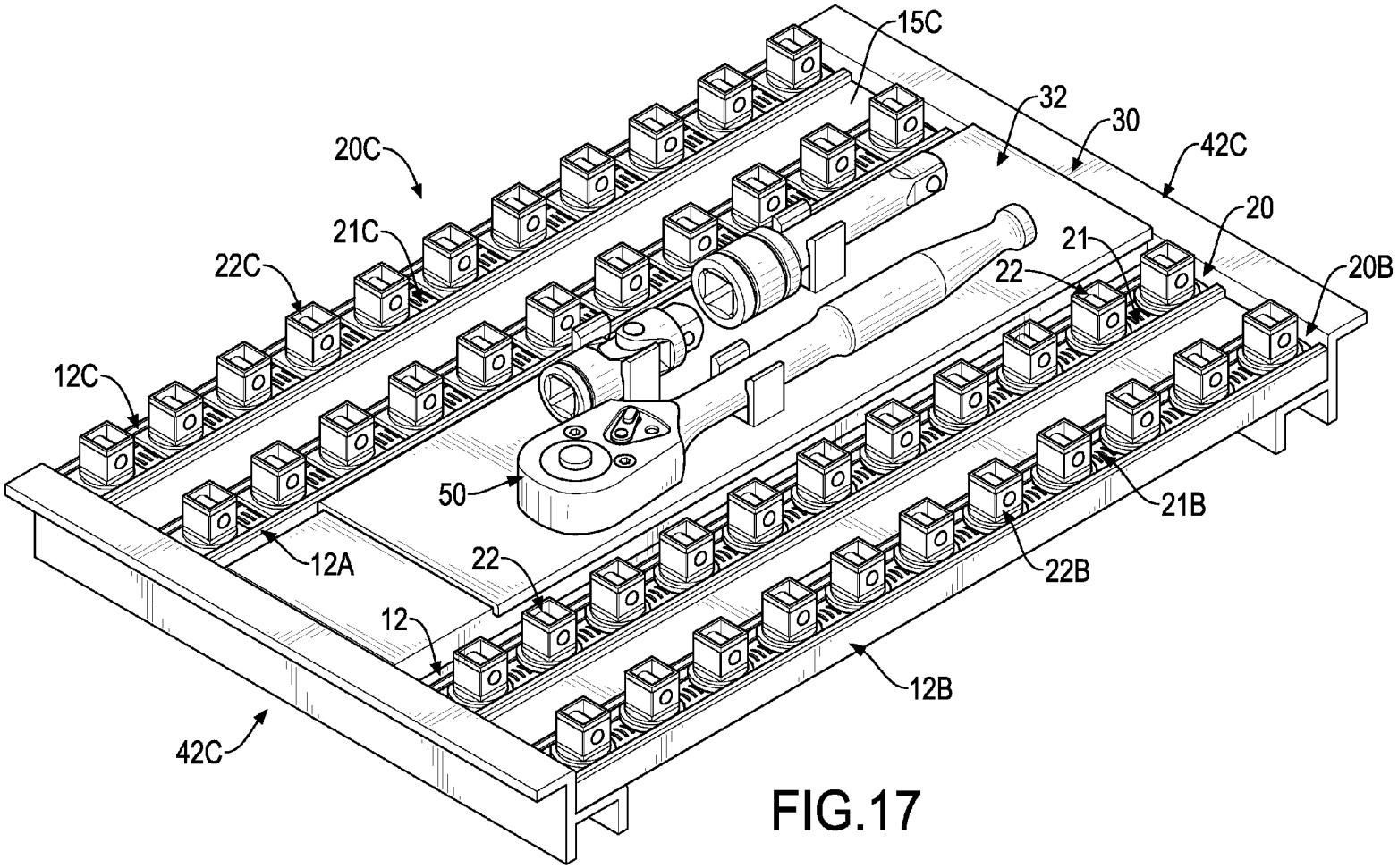
FIG. 17 is a perspective view of a third embodiment of a composite tool holder in accordance with the present invention.
Figure 18:
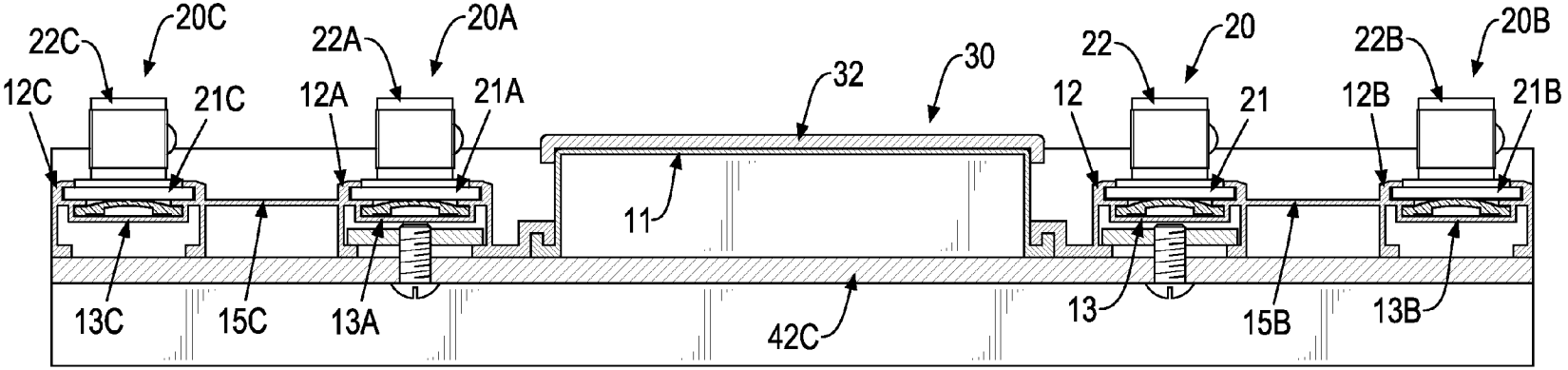
FIG. 18 is an enlarged side view in partial section of the composite tool holder in FIG. 17.

With reference to FIGS. 17 and 18, a fourth embodiment of a composite tool holder in accordance with the present invention is substantially the same as the third embodiment except for the following features. The composite tool holder further has an extending-auxiliary first track 12C, an extending-auxiliary second track 13C, and an additional-auxiliary socket set 20C. The extending-auxiliary first track 12C is connected to and parallel with the auxiliary first track 12A by an extending panel 15C, the extending-auxiliary second track 13C is formed on the extending-auxiliary first track 12C, and the additional-auxiliary socket set 20C is connected to the extending-auxiliary first track 12C and the extending-auxiliary second track 13C. Furthermore, the structures of the extending-auxiliary first track 12C, the extending-auxiliary second track 13C, and the additional-auxiliary socket set 20C are respectively and substantially the same as the auxiliary first track 12A, the auxiliary second track 13A, and the auxiliary socket set 20A. In addition, with the increasing structures of the extending-auxiliary first track base 12C, the extending-auxiliary second track 13C, and the additional-auxiliary socket set 20C, the composite tool holder may further store more sleeves on the composite tool holder.

By the above technical features, the composite tool holder of the invention allows the user to fix and store the sleeves 70 and the hand tools 50 on the base 10 at the same time by disposing the socket set 20, the auxiliary socket set 20A, the additional socket set 20B, the additional-auxiliary socket set 20C, and the hand tool set 30 on the base 10. Therefore, it allows the user to use or store the sleeves 70 and the hand tools 50 at the same time and prevents the user from forgetting to bring the sleeves 70 or the hand tools 50. In addition, the structural strength can be enhanced by the bracket sets 40 disposed on two sides of the base 10, and the user can carry the composite tool holder by holding the two supporting plates 424. The invention provides the composite tool holder to store the sleeves 70 and the hand tool 50 at the same time, and this is convenient in use.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A composite tool holder comprising:

a base having a substrate having a top surface;

a bottom surface;

two elongated sides; and a length; and a first track detachably connected to one of the elongated sides of the substrate by a hooking structure between the substrate and the first track, and having a length being equal to the length of the substrate;

a top surface;

a bottom surface;

an upper opening formed through the top surface of the first track; and a sliding slot formed in the first track and communicating with the upper opening; and a second track formed on the bottom surface of the first track, and having a top opening formed through the bottom surface of the first track and communicating with the sliding slot; and an engaging slot formed in the second track and communicating with the top opening;

a socket set connected to the base and having a positioning plate disposed in the engaging slot of the second track, and having two long opposite sides;

a middle;

an abutting portion bent upwardly from the long opposite sides to the middle of the positioning plate and having a top surface; and multiple engaging recesses formed in the top surface of the abutting portion at spaced intervals; and multiple positioning blocks slidably mounted in the first track and abutting the positioning plate, and each one of the positioning blocks having an engaging portion mounted in the sliding slot of the first track, abutting the abutting portion of the positioning plate, and having a bottom surface;

a top surface; and an engaging element formed on and protruding downwardly from the bottom surface of the engaging portion and selectively engaging with one of the engaging recesses of the positioning plate to hold the positioning block securely on the positioning plate; and an inserting portion formed on and protruding from the top surface of the engaging portion and extending out of the first track via the upper opening;

a hand tool set detachably connected to the base and having at least one holding component deposited on the substrate; and a bracket set detachably connected to the base beside the socket set, and having two supporting bases respectively connected to two sides of the base to enclose the first track and the second track.

2. The composite tool holder as claimed in claim 1, wherein the substrate has at least one receiving hole formed through the top surface and the bottom surface of the substrate; and the hand tool set has a mounting cover detachably mounted on the substrate, and the mounting cover has a top surface;

a bottom surface; and at least one mounting hole formed through the top surface and the bottom surface of the mounting cover and aligning with the at least one receiving hole of the substrate to receiving a protrusion head of a hand tool.

3. The composite tool holder as claimed in claim 2, wherein the substrate has multiple assembling holes formed through the top surface and the bottom surface of the substrate at spaced intervals; and the mounting cover has multiple inserting tubes formed on and protruding downwardly from the bottom surface of the mounting cover at spaced intervals, and respectively mounted into the assembling holes of the substrate when the bottom surface of the mounting cover abuts the top surface of the substrate;

multiple washers respectively mounted around the inserting tubes that extend through the substrate; and multiple fasteners respectively connected to the inserting tubes and pressed against the washers to mount the mounting cover securely on the substrate.

4. The composite tool holder as claimed in claim 3, wherein each one of the at least one holding component is formed on the top surface of the mounting cover and has a combining portion formed on the top surface of the mounting cover and has a top surface; and a holding portion being U-shaped, integrally formed on the top surface of the combining portion and disposed above the mounting cover, and having two free ends; and two holding protrusions respectively formed on the free ends of the holding portion.

5. The composite tool holder as claimed in claim 4, wherein the base has two enclosed tracks, one of the enclosed tracks is formed downwardly on the bottom surface of the substrate along one of the elongated sides that is opposite to the first track, and communicates with some of the assembling holes, and the other one of the enclosed track is formed downwardly on the bottom surface of the first track around the second track;

each one of the enclosed tracks has a bottom surface;

a lower opening formed through the bottom surface of the enclosed track; and an enclosed slot formed in the enclosed track and communicating with the lower opening;

the bracket set has multiple fixing plates, and each one of the fixing plates is disposed in one of the enclosed tracks and near an end of the substrate or an end of the first track, and has a fixing hole formed through the fixing plate and communicating with the lower opening of a corresponding enclosed track; and each one of the supporting bases has an enclosed plate disposed vertically and abutting one of two sides of the base to enclose the first track, the second track, and the enclosed tracks;

an extending plate transversally formed on and protruding from the enclosed plate and abutting the enclosed tracks under the base, and having two fixing holes formed through the extending plate at a spaced interval; and two fixing components respectively mounted through the two fixing holes and respectively connected to the fixing holes of the fixing plates 41 that are mounted at a same side of the base.

6. The composite tool holder as claimed in claim 5, wherein each one of the supporting bases has a supporting plate horizontally formed on a top of the enclosed plate, and the supporting plate is aligned to the substrate.

7. The composite tool holder as claimed in claim 6, wherein each one of the engaging recesses is curved; and the engaging element of the engaging portion of each one of the positioning blocks is an engaging ring, and a part of the engaging ring engages in one of the engaging recesses and the remaining part of the engaging ring presses against the top surface of the abutting portion.

8. The composite tool holder as claimed in claim 7, wherein the engaging portion of each one of the positioning blocks is a circular plate to be rotated relative to the first track; and the inserting portion of each one of the positioning blocks has an outer surface; and a constraining protrusion deposited on the outer surface of the inserting portion.

9. The composite tool holder as claimed in claim 4, wherein the composite tool holder further has an auxiliary first track detachably connected to one of the elongated sides of the substrate by a hooking structure between the substrate and the auxiliary first track, and is opposite to the first track;

an auxiliary second track formed on the auxiliary first track; and an auxiliary socket set connected to the auxiliary first track and the auxiliary second track, and having a positioning plate mounted in the auxiliary second track, and having an abutting portion having a top surface; and multiple engaging recesses being elongated and formed in the top surface of the abutting portion at spaced intervals; and multiple positioning blocks un-rotatably and slidably mounted in the auxiliary first track and abutting the positioning plate, and each one of the positioning blocks having an engaging portion being rectangular, mounted in the auxiliary first track, and abutting the abutting portion of the positioning plate; and an inserting portion being an elongated engaging rib, and selectively engaging with one of the engaging recesses of the positioning plate to hold the positioning block securely on the positioning plate;

wherein the first track and the auxiliary first track are respectively connected to the two elongated sides of the substrate;

the base has two enclosed tracks respectively formed downwardly on the first track and the auxiliary first track respectively around the second track and the auxiliary second track; and a length of each one of the supporting bases is long enough to enclose the first track, the auxiliary track, the second track, the auxiliary second track, and the enclosed tracks.

10. The composite tool holder as claimed in claim 9, wherein the composite tool holder further has an extending first track connected to and parallel with the first track by an extending panel and having a same structure as the first track;

an extending second track formed on the extending first track and having a same structure as the second track; and an additional socket set connected to the extending first track and the extending second track and having a same structure as the socket set.

11. The composite tool holder as claimed in claim 10, wherein the composite tool holder further has an extending-auxiliary first track connected to and parallel with the auxiliary first track by an extending panel and having a same structure as the auxiliary first track;

an extending-auxiliary second track formed on the extending-auxiliary first track and having a same structure as the auxiliary second track; and an additional-auxiliary socket set connected to the extending-auxiliary first track and the extending-auxiliary second track and having a same structure as the auxiliary socket set.

* * * * *